US011459872B2

(12) United States Patent
Enblom et al.

(10) Patent No.: US 11,459,872 B2
(45) Date of Patent: Oct. 4, 2022

(54) SYSTEM AND METHOD FOR ASSESSING THE EFFICIENCY OF A DRILLING PROCESS

(71) Applicant: EPIROC ROCK DRILLS AKTIEBOLAG, Orebro (SE)

(72) Inventors: Samuel Enblom, Örebro (SE); Erik Jakobsson, Vintrosa (SE); Mattias Göthberg, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 124 days.

(21) Appl. No.: 16/310,719

(22) PCT Filed: May 19, 2017

(86) PCT No.: PCT/SE2017/050538
§ 371 (c)(1),
(2) Date: Dec. 17, 2018

(87) PCT Pub. No.: WO2017/217905
PCT Pub. Date: Dec. 21, 2017

(65) Prior Publication Data

US 2019/0323336 A1 Oct. 24, 2019

(30) Foreign Application Priority Data

Jun. 17, 2016 (SE) ..... 1650860-8

(51) Int. Cl.
*E21B 44/08* (2006.01)
*E21B 47/01* (2012.01)
(Continued)

(52) U.S. Cl.
CPC ..... *E21B 44/08* (2013.01); *E21B 47/01* (2013.01); *B25D 2250/221* (2013.01);
(Continued)

(58) Field of Classification Search
CPC ..... E21B 44/08; E21B 7/022; E21B 47/01; B25D 2250/221
(Continued)

(56) References Cited

U.S. PATENT DOCUMENTS 4,671,366 A 6/1987 Uitto et al.
4,793,421 A * 12/1988 Jasinski ..... E21B 44/00 173/11
(Continued)

FOREIGN PATENT DOCUMENTS

EP 2811110 A1 12/2014
JP 2012504197 A 2/2012
(Continued)

OTHER PUBLICATIONS

International Search Report with Written Opinion dated Aug. 15, 2017 in corresponding International Application No. PCT/SE2017/050538 (12 pages).
(Continued)

*Primary Examiner* — Joshua G Kotis
(74) *Attorney, Agent, or Firm* — Sage Patent Group

(57) ABSTRACT

A method for determining efficiency of a drilling process comprising the steps of: transferring energy via a tool member to the material in which drilling is to be performed by means of a drilling configuration; detecting waves which are propagating in said tool member of said drilling configuration during drilling as a result of energy provision; detecting said waves by means of at least two sensor means arranged on mutually opposite sides of said tool member adjacent to, on a certain distance from, said tool member, which sensor means are based on inductive and/or capacitive detection of said waves in said tool member; and based on results of said detection, determining said efficiency of said drilling process.

9 Claims, 6 Drawing Sheets

(51) Int. Cl.
*E21B 7/02* (2006.01)
*E21B 44/00* (2006.01)
*E21B 15/00* (2006.01)

(52) U.S. Cl.
CPC ..... *E21B 7/022* (2013.01); *E21B 7/025* (2013.01); *E21B 15/006* (2013.01); *E21B 44/00* (2013.01)

(58) Field of Classification Search
USPC ..... 173/113, 142; 175/24, 27, 40
See application file for complete search history.

(56) References Cited

U.S. PATENT DOCUMENTS 6,179,066 B1 * 1/2001 Nasr ..... E21B 47/01 175/45
6,454,021 B1 9/2002 Watanabe
7,051,525 B2 * 5/2006 Keskiniva ..... B25D 9/14 60/446
7,114,576 B2 * 10/2006 Keskiniva ..... E21B 44/00 173/2
7,424,920 B2 * 9/2008 Bergstrand ..... E21B 44/00 175/24
7,717,190 B2 * 5/2010 Keskiniva ..... E21B 44/08 173/1
7,757,552 B2 * 7/2010 Bogath ..... E21B 47/007 73/152.49
7,886,843 B2 * 2/2011 Weddfelt ..... E21B 1/02 175/24
7,895,900 B2 * 3/2011 Keskiniva ..... E21B 44/02 73/781
9,115,555 B2 * 8/2015 McMillon ..... E21B 23/01
2002/0050168 A1 5/2002 Bongers-Ambrosius et al.
2008/0035376 A1 * 2/2008 Freyer ..... E21B 44/00 175/45
2013/0333872 A1 * 12/2013 McMillon et al. ..... H01F 7/04 166/66.5
2015/0002159 A1 * 1/2015 Ikegami ..... G01V 1/523 324/346
2017/0328143 A1 * 11/2017 Ang ..... E21B 47/01
2018/0038218 A1 * 2/2018 Hay ..... E21B 49/00
2018/0187540 A1 * 7/2018 Hanski ..... E21B 7/025

FOREIGN PATENT DOCUMENTS

WO 9947313 A1 9/1999
WO 2006126933 A1 11/2006
WO 2008036013 A1 3/2008
WO 2008060216 A1 5/2008
WO 2008127173 A1 10/2008
WO 2010037905 A1 4/2010
WO 2010117331 A1 10/2010
WO 2011077001 A1 6/2011

OTHER PUBLICATIONS

Swedish Office Action with Search Report dated Feb. 7, 2017 in corresponding Swedish Application No. 1650860-8 (15 pages).
European Office Action in corresponding European Application No. 17 813 684.2 dated Oct. 8, 2020 (6 pages).
Indian First Examination Report in corresponding Indian Application No. 201817048730 dated Feb. 9, 2021 (18 pages).
Japanese Office Action in corresponding Japanese Patent Application No. 2018-565823 dated May 12, 2021 (4 pages).

* cited by examiner

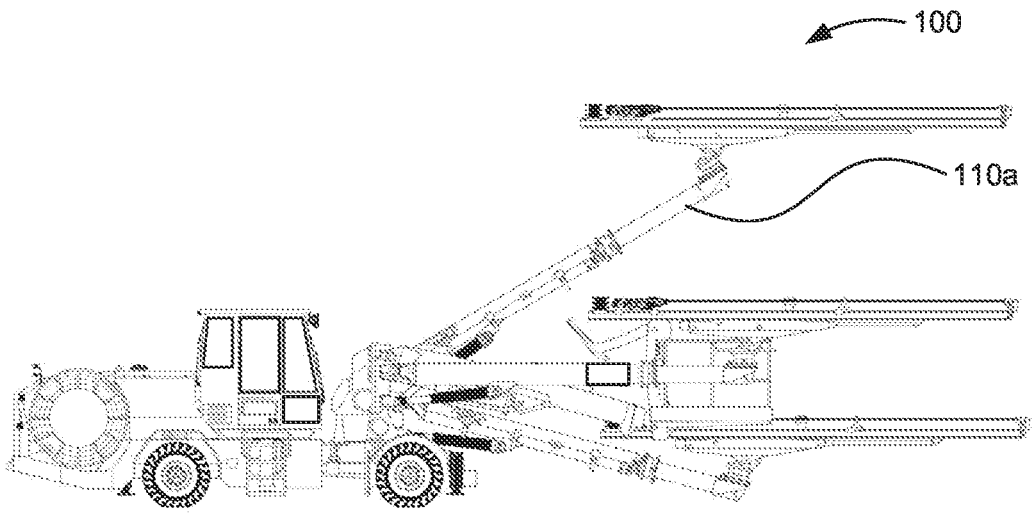
Fig. 1
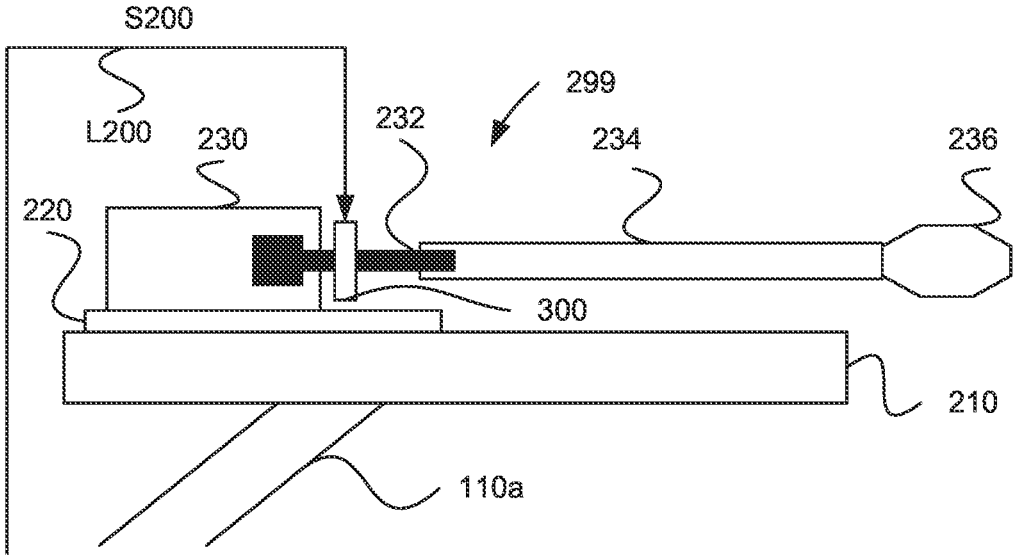
Fig. 2
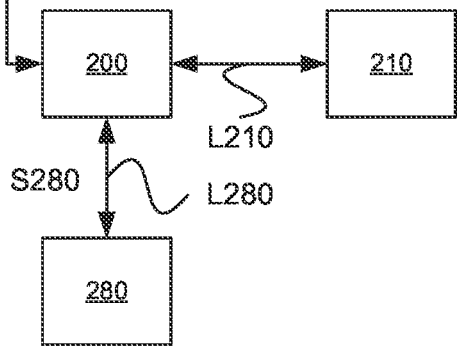

SYSTEM AND METHOD FOR ASSESSING THE EFFICIENCY OF A DRILLING PROCESS

CROSS-REFERENCE TO RELATED APPLICATIONS

This application is a U.S. National Stage application of PCT/SE2017/050538, filed May 19, 2017 and published on Dec. 21, 2017 as WO/2017/217905, which claims the benefit of Swedish Patent Application No. 1650860-8, filed Jun. 17, 2016, all of which are hereby incorporated by reference in their entireties.

TECHNICAL FIELD

The present invention relates to a method for determining efficiency of a drilling process. The invention also relates to a computer program product comprising program code for a computer for implementing a method according to the invention. The invention also relates to a system for determining efficiency of a drilling process and a drilling rig which is equipped with the system. The invention also relates to a detecting unit of a system for determining efficiency of a drilling process.

BACKGROUND

When excavating rocks, or other hard materials, various kinds of drilling rigs or machines may be used. A drilling rig may comprise a number of booms wherein each one has a drilling machine arranged on a slidably arranged sledge of a feeder. The feeder may be arranged so as to a in a controlled way affect the pressure by means of a drilling steel provided with a cutter against the rock which is to be excavated. Further, said drilling machine may be arranged for excavating rocks by rotational movement as well as strikes. It is desired that an operator of a drilling rig may adapt operation of each drilling machine so as to in an optimal way excavate rocks, for example when mining or preparing tunnels.

The form and energy content of shock waves are proportional to efficiency of excavating. As shock waves are generated by means of said striking it is of interest to determine efficiency regarding the drilling process so as to be able to adapt operation of a corresponding drilling machine. Today there are various techniques for determining efficiency of a drilling process.

According to a first example strain meters are used, which strain meters are rigidly arranged by means of fastening means on the drilling steel of the drilling machine. This variant is however in practice only useful for a laboratory environment for many reasons. Firstly, the total operational time of meters of today is relatively short. Secondly, a wire arranged between the strain meter and the meter system is required, which as such disqualifies this first example for use in field operation. It has been proved to be not advantageous to mount required electronics for the strain meter on the drilling steel as shock waves are causing degradation of this electronics. Applications wherein wireless techniques are used for transferring information from said strain meters to required electronics provide unsatisfying performance.

According to a second example an inductive coil member which winding is arranged about said drilling steel of said drilling machine is used. Said drilling steel is hereby running through said coil. This example is functioning acceptable but presents very noisy signals, which contributes to that the method is not providing accurate results.

SUMMARY OF THE INVENTION

There is a need for achieving a method for determining efficiency of a drilling process which does not present the disadvantages mentioned above involving application of wire connected sensors directly onto a drilling steel of a drilling machine and which also provides high accuracy of detected shock waves and/or tensile waves of said drilling steel.

An object of the present invention is to provide a novel and advantageous method for determining efficiency of a drilling process.

Another object of the present invention is to provide a novel and advantageous system for determining efficiency of a drilling process and a novel and advantageous computer program for determining efficiency of a drilling process.

Another object of the invention is to provide a novel and advantageous detecting unit of a system for determining efficiency of a drilling process.

Yet another object of the invention is to provide a method, a system and a computer program for achieving, for an operator, secure and user-friendly operation of a drilling machine with improved efficiency on the basis of determined efficiency of a drilling process.

Yet another object of the invention is to provide a method, a system and a computer program allowing accurate continuous determination of efficiency of a drilling process.

Yet another object of the invention is to provide a relatively cheap and during operation cost effective system for determining efficiency of a drilling process.

Yet another object of the invention is to provide an alternative method, an alternative system and an alternative computer program for determining efficiency of a drilling process.

At least some of these objects are achieved by a method for determining efficiency for a drilling process according to the above. Other objects are achieved by the inventive method. The technical effects and the advantages which are presented by features of the inventive method are also valid for corresponding features of the system depicted herein.

According to an aspect of the present invention there is provided a method for determining efficiency of a drilling process, comprising the steps of:

- transferring energy via a tool member to the material in which drilling is to be performed by means of a drilling configuration;
- detecting waves which are propagating in said tool member of said drilling configuration during drilling as a result of energy provision;
- detecting said waves by means of at least two sensor means arranged on mutually opposite sides of said tool member adjacent to, on a certain distance from, said tool member, which sensor means are based on inductive and/or capacitive detection of said waves in said tool member; and
- based on results of said detection, determining said efficiency of said drilling process.

Hereby is achieved a versatile and cost effective method for determining said efficiency of said drilling process. The method is versatile in that both tensile waves and shock waves may be detected in a reliable way. This renders that the method is applicable to a set of different drilling configurations/drilling machines, regarding a drilling rig as well as hand-held or stand-alone drilling configurations/drilling machines. By arranging at least two sensor means on mutually opposite sides of said tool member adjacent to, on a certain distance from, said tool member, a very accurate detection of said waves is achieved.

It is advantageous to be able to measure waves of said tool member without the need of having a sensor mounted on said tool member, e.g. a drilling steel of the drilling configuration.

Advantageously said drilling process may be continuously optimized on the basis of said determined efficiency of said drilling process regarding e.g. minimization of rock reflexes or a ration between tensile waves and pressure waves.

It is also possible to determine if connections are loose at said tool member as well as detecting erroneous function of striking arrangements of said drilling configuration.

The method further comprises the steps of:

detecting said waves by means of four sensor means symmetrically arranged at mutually opposite sides of said tool member adjacent to, on a certain distance from, said tool member; and processing results from said sensor means pairwise as a basis for said determination.

Hereby said four sensor means may advantageously be used pairwise, whereby detected "interferences" may be reduced or eliminated. These interferences may be constituted by flex waves, wobbling tool members and broken fixtures. By processing waves detected by the sensor means by means of mathematical models of an electronic control unit, a correct continuous state of the tool member may be provided. By arranging sensor means pairwise on opposite sides of said tool member flex waves components of pressure waves and tensile waves may be filtered in an accurate manner.

The method may comprise the step of:

positioning said sensor means at a preferred position along said tool member where lateral movements of said tool member are relatively small. One such position may advantageously be at a neck adapter of the drilling configuration, i.e. the portion which is connecting the drilling machine to a drilling steel. This position is allowing an easy connecting procedure regarding the detecting device comprising said sensor means. By positioning said sensor means at said neck adapter flex waves will be appearing to a less extent. Alternatively said sensor means may be arranged at one end of said drilling steel, i.e. at said cutter or at a position close to said neck adapter of said drilling steel.

The method may comprise the step of:

providing said energy by means of strikes and/or rotation. Hereby a versatile method is achieved. The method is thus applicable to machines using striking energy for breaking rocks. The method is thus applicable to machines using energy generated by rotational movement (during feeding) of the drilling steel for breaking rocks. According to one embodiment the inventive method is applicable to machines using a combination of strikes and rotational movement for breaking rocks.

The method may comprise the step of:

inductively detecting said waves by means of oppositely arranged coil members comprising at least one permanent magnet as coil core. Said at least one permanent magnet is arranged to generate a substantially constant magnetic field about said tool member, which tool member is vibrating/moving during operation. These movements are affecting said magnetic field, whereby changes in said magnetic field may be detected by means of said at least two sensor means. An electrical signal from said sensor means is representing the movement of said tool member, the content of said signal is the basis for said assessment of said drilling process. Alternatively another unit than a permanent magnet may be used for generating a substantially constant magnetic field about said tool member, for example a direct current electromagnet.

The method may comprise the step of:

arranging said coil members in a substantially elliptic configuration having the shortest ellipse axis substantially parallel with a longitudinal direction of said tool member. Hereby an accurate and reliable detection of said waves of said tool member is achieved.

The method may comprise the step of:

determining said efficiency of said drilling process on the basis of comparisons between original pressure waves and reflecting tensile waves in said tool member; or determining said efficiency of said drilling process on the basis of characteristics of a few reoccurring tensile waves in said tool member.

Hereby a versatile method according to an aspect of the invention is advantageously achieved. By comparing original pressure/shock waves and corresponding tensile waves/reflexes in said tool member the effective work may be determined. In a case where rotational movement of a cutter applied under pressure against a rock during breaking generates tensile waves, these may be analysed for determining efficiency of said drilling process without comparison with shock waves.

According to one embodiment said efficiency of said drilling process may be determined on the basis of characteristics of reflecting pressure waves.

The method may comprise the step of:

detecting waves in said tool member by means of additional sensor means oriented in a symmetrical configuration corresponding to a certain rotation relatively an already provided configuration of sensor means for detection of torsion waves in said tool member. By providing sensor means having another orientation compared to an already provided configuration of sensor means it is possible to detect said torsion waves in an effective way.

The method may comprise the step of:

continuously controlling said drilling process based on such determined efficiency for an efficiency optimization. Hereby for example feeding pressure, rotational speed, striking frequency, striking power etc. may be adapted during operation for achieving an improved rock breaking process and thus a more efficient drilling process.

According to an aspect of the invention there is provided a method for determining efficiency of a drilling process where no striking is present and where drilling is performed by means of a drilling configuration having a tool member, comprising the steps of:

detecting waves which are propagating in said tool member of said drilling configuration during drilling, which waves are generated by the material in which drilling is performed;

detecting said waves by means of at least two sensor means arranged on mutually opposite sides of said tool member adjacent to, on a certain distance from, said tool member, which sensor means are based on inductive and/or capacitive detection of said waves in said tool member; and based on results of said detection, determining said efficiency of said drilling process.

According to an aspect of the present invention there is provided a system for determining efficiency of a drilling process, comprising:

means for transferring energy via a tool member to the material in which drilling is to be performed;

means for detecting waves, which are propagating in said tool member of said drilling configuration during drilling as a result of energy provision;

at least two sensor means for detecting said waves, which sensor means are arranged on mutually opposite sides of said tool member adjacent to, on a certain distance from, said tool member, which sensor means are based on inductive and/or capacitive detection of said waves in said tool member; and means for determining said efficiency of said drilling process on the basis of results of said detection.

By detecting waves of said tool member during (field) operation a drilling process may be optimized to a substantially ideal rock breaking, efficiency, total operational time of the drilling steel, or a combination of said parameters.

The system has four sensor means symmetrically arranged at mutually opposite sides of said tool member adjacent to, on a certain distance from, said tool member, and where the system further comprises means for processing results of said sensor means pairwise as a basis for said determination.

Said sensor means may be provided at a preferred position along said tool member at which lateral movements of said tool member are relatively small.

The system may comprise means for providing said energy by means of strikes and/or rotation.

The system may comprise:

oppositely arranged coil members comprising at least one permanent magnet as a coil core for inductively detecting said waves.

The system may comprise:

coil members arranged in an substantially elliptic configuration having the shortest ellipse axis substantially parallel with a longitudinal direction of said tool member.

The system may comprise:

means for determining said efficiency of said drilling process on the basis of comparisons of original pressure waves and reflected tensile waves in said tool member; or means for determining said efficiency of said drilling process on the basis of characteristics of a few reoccurring tensile waves in said tool member.

The system may comprise:

additional sensor means for detecting waves in said tool member, which sensor means are oriented in an symmetrical configuration corresponding to a certain rotation relatively an already provided configuration of sensor means for detecting torsion waves in said tool member.

The system may comprise:

means for continuously controlling said drilling process based on such determined efficiency for an efficiency optimisation.

According to an aspect of the present invention there is provided a detecting unit of a system for determining efficiency of a drilling process, which system comprises means for detecting waves, which are propagating in a tool member of a drilling configuration during drilling as a result of energy provision, comprising:

at least two sensor means for detecting said waves, which sensor means are arranged on mutually opposite sides of said tool member adjacent to, on a certain distance from, said tool member, which sensor means are based on inductive and/or capacitive measuring of said waves in said tool member.

The inventive detecting unit may be installed afterwards to an existing drilling configuration. Hereby software/electronics/other equipment for processing information regarding said waves determined by the detecting unit may be installed afterwards at an existing drilling configuration.

The detecting unit has four sensor means symmetrically arranged on mutually opposite sides of a hole for said tool member adjacent to, on a certain distance from, said tool member.

The detecting unit further comprises means for processing results from said sensor means pairwise as basis for said determination. These means may be constituted by a control unit of a drilling rig.

The inventive method and the inventive system may advantageously be used at a drilling rig. According to one aspect of the present invention there is provided a drilling rig which comprises the system for determining efficiency of a drilling process. The drilling rig may be intended for mining. According to one aspect of the present invention there is provided a drilling rig comprising the inventive detecting unit.

According to an aspect of the invention there is provided a computer program for determining efficiency of a drilling process, wherein said computer program comprises program code for causing an electronic control unit or a computer connected to the electronic control unit to perform the steps according to the above.

According to an aspect of the invention there is provided a computer program for determining efficiency of a drilling process, wherein said computer program comprises program code stored on a computer readable-medium for causing an electronic control unit or a computer connected to the electronic control unit to perform the steps according to the above.

According to an aspect of the invention there is provided a computer program for determining efficiency of a drilling process, wherein said computer program comprises program code stored on a computer-readable medium for causing an electronic control unit or a computer connected to the electronic control unit to perform at least one step according to the herein depicted method steps.

According to an aspect of the invention there is provided a computer program product comprising a program code stored on a computer-readable medium for performing method steps according to the above, when said computer program is run on an electronic control unit or a computer connected to the electronic control unit.

According to an aspect of the invention there is provided a computer program product comprising a program code stored on a computer-readable, non-volatile, medium for performing method steps according to the above, when said computer 15 program is run on an electronic control unit or a computer connected to the electronic control unit.

Further objects, advantages and novel features of the present invention will become apparent to one skilled in the art from the following details, and also by putting the invention into practice. Whereas the invention is described below, it should be noted that it is not limited to the specific details described. One skilled in the art having access to the teachings herein will recognise further applications, modifications and incorporations in other fields, which are within the scope of the invention.

BRIEF DESCRIPTION OF THE DRAWINGS

For fuller understanding of the present invention and its further objects and advantages, the detailed description set out below should be read in conjunction with the accompanying drawings, in which the same reference notations denote similar items in the various diagrams, and in which:

FIG. 1 schematically illustrates a drilling rig, according to an embodiment of the invention;

FIG. 2 schematically illustrates a drilling machine arranged on a boom of a drilling rig;

DETAILED DESCRIPTION OF THE DRAWINGS

Figure 3A:
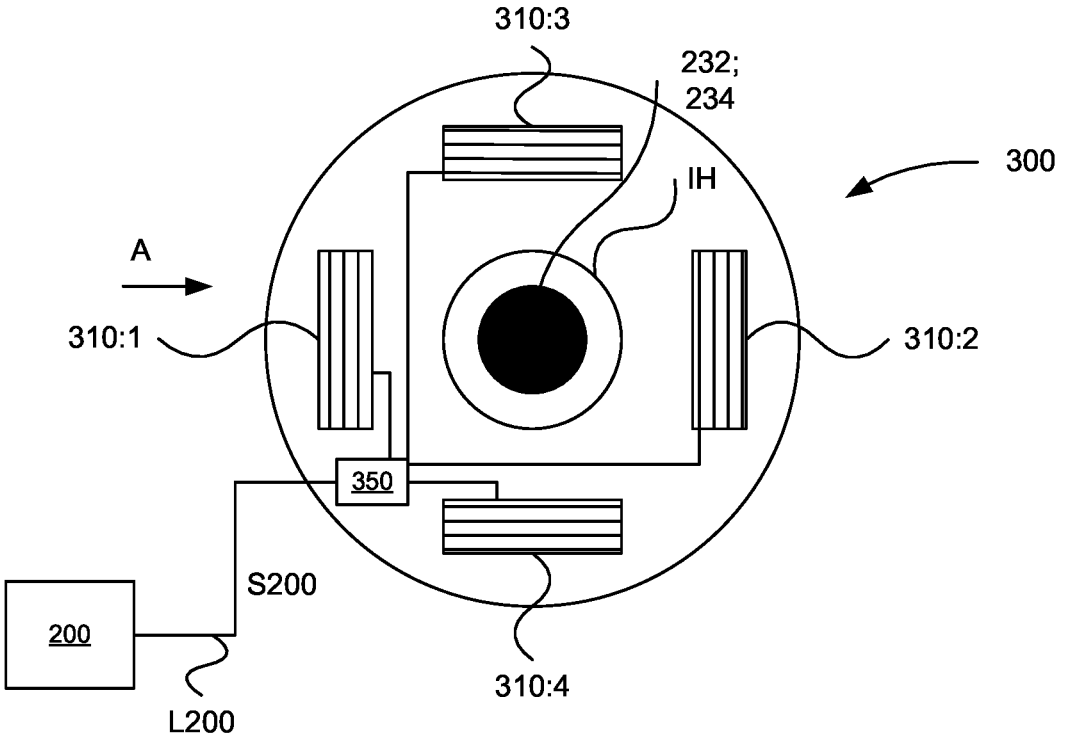
FIG. 3*a* schematically illustrates a detecting unit, according to an embodiment of the invention.

With reference to FIG. 1 a drilling rig 100 is illustrated. The exemplified drilling rig is according to one embodiment adapted for mining. The drilling rig 100 is equipped with the invented system, which is depicted in greater detail with reference to for example FIGS. 2 and 3*a*-3*d* herein.

The drilling rig 100 may be controlled by an operator, whereby one or more operators may be on-board during propulsion and/or operation of drilling rig. According to an alternative the drilling rig 100 is remotely controlled, whereby one or more operators may be located in a control centre above ground. According to an alternative the drilling rig is arranged for autonomous control and operation of the inventive system.

Herein the term "link" refers to a communication link which may be a physical wire, such as an opto-electronic communication wire, or a non-physical connection, such as a wireless connection, for example a radio or microwave link.

FIG. 2 is schematically illustrating a drilling configuration 299 comprising a drilling machine 230 and a drilling steel 234 with a cutter 236, where said drilling steel 234 is detachably arranged to said drilling machine 230 by means of a neck adaptor 232. Said drilling steel 234 may comprise multiple pieces which are attached by means of a respective thread configuration at so called connections. Herein the units neck adaptor 232, drilling steel 234 and cutter 236 are denoted tool member.

Operation of said tool member for mining of rocks or other materials is herein denoted drilling process.

Said drilling machine 230 may be arranged to rotate said drilling steel 234 at a suitable rotational speed for breaking a rock or other materials. Said drilling machine 230 may also be arranged with a striking arrangement generating shock-waves through said drilling steel 234 for mining of rocks or other materials. According to a variant said drilling machine 230 is arranged for achieving rotational movement of said drilling steel 234 as well as power pulses by means of said striking arrangement. Said drilling configuration 299 may be a stand-alone handheld drilling configuration.

According to this example said drilling configuration 299 is arranged on a sledge device 220 which is slidably arranged on a feeder 210. Said feeder 210 is fixedly secured at an arm 110*a*, which is illustrated with reference to FIG. 1. Herein a feed pressure of said drilling steel 234 is achieved against the rock which is to be mined.

A detection unit 300 is arranged about said neck adaptor 232. Said detection unit is depicted in grader detail with reference to for example the FIGS. 3*a* to 3*e* below. Said detection unit 300 may be arranged about a suitable position in a longitudinal direction of said neck adapter 232 or said drilling steel 234. Preferably said detection unit 300 is positioned at a suitable position along said tool member where lateral movements of said tool member are relatively small. A position where the movement of said tool member is relatively small may be adjacent to said cutter 236 or about said drilling steel 234 in contiguity of said neck adaptor 232 or about said drilling steel 234 adjacent to said neck adapter. Since said detection unit 300 comprises sensor means which are sensitive for magnetic interference it might be advantageous to position said detection unit on a suitable distance from said drilling machine 230 or on a suitable distance from other members of the drilling rig 100 which are generating a magnetic field.

For arranging said detection unit 300 at said tool member in a robust way suitable support means may be used. Further, suitable magnetic shielding devices may be mounted at said detection unit 300 so as to, where applicable, reduce magnetic affection of said detection unit 300.

Said detection unit 300 is signal connected to a first control unit 200 via a link L200. Said detection unit 300 is arranged to send signals S200 to said first control unit 200 via said link L200. Said signals S200 may comprise information about by means of said detection unit 300 detected waves generated at said tool member.

Said first control unit 200 is arranged for communication with presentation means 280 via a link L280. Said first control unit 200 is arranged to send signals S280 comprising information based on, or related to said determination of efficiency of said drilling process. According to an embodiment instructions for an operator on the drilling rig 100 may be presented, were said instructions are generated on the basis of said determination for optimizing operation of said drilling configuration 299. Said instructions may be presented in the shape of alphanumerical signs or suitable signals/colour coding, etc.

A second control unit 210 is arranged for communication with a first control unit 200 via a link L210. The second control unit 210 may be detachable connected to the first control unit 200. The second control unit 210 may be an external control unit of the drilling rig 100. The second control unit 210 may be arranged to perform the innovative method steps according to the invention. The second control unit 210 may be used for downloading software to the first control unit 200, in particular software for performing the innovative method. The second control unit 210 may alternatively be arranged for communication with the first control unit 200 via an internal network in a drilling rig. The second control unit 210 may be arranged to perform substantially the same functions as the first control unit 200, such as for example determining said efficiency of said drilling process.

FIG. 3*a* schematically illustrates a detecting unit 300, according to an embodiment of the invention. Said detection unit 300 may be in a form having a substantially circular cross section and comprising a hole IH. Said hole IH has dimensions suitable for the tool member which it is about to enclose. Hereby said detection unit 300 may be arranged about said neck adaptor 232 or said drilling steel 234.

According to an embodiment said detection unit 300 comprises four sensor means 310:1, 310:2, 310:3 and 310:4 in the form of inductive coils with suitable wires. Hereby the four sensor means 310:1, 310:2, 310:3 and 310:4 may be arranged as two pairs arranged on mutually opposite sides of said tool member adjacent to, on a certain distance from, said tool member 232, 234. A first pair hereby comprises a first coil member 310:1 and a second coil member 310:2. A second pair hereby comprises a third coil member 310:3 and a fourth coil member 310:4. The coil members' central axis is hereby arranged vertically to a longitudinal axis of said tool member 232, 234. According to an embodiment said coil members are arranged for inductive measurements of said waves in said tool member 232, 234.

Said detection unit 300 may comprise a processing unit 350. Said processing unit 350 is arranged for communication with a respective sensor means 310:1, 310:2, 310:3 and 310:4 via suitable electrical wires. Hereby said processing unit 350 may receive electrical signals from respective sensor means 310:1, 310:2, 310:3 and 310:4 and forward these to said first control unit 200 via said link L200. Said electrical signals may comprise information about the waves in said tool member 232, 234 which have been detected by means of said sensor means. Theses electrical signals may present variations in voltage representing said detected waves.

According to an example embodiment said processing unit 350 is arranged to only receive said signals from the various sensor means and forward these to said first control unit 200 for processing an analysis and determination of efficiency of said drilling process. According to an example embodiment said processing unit 350 is arranged with necessary electronics/software for processing said received signals and perform said determination of efficiency of said drilling process. Hereby said determination of said drilling process may thus be performed at only said processing unit 350, only said first control unit 200 (or second control unit 210), or partly in said processing unit 350 and partly in said first control unit 200.

According to an embodiment said detection of variations in magnetic fields caused by waves of said tool member 232, 234 is performed without an external magnetic field. Hereby permanent magnets of said sensor means are used for amplification.

According to an embodiment said detection of variations in magnetic fields caused by waves of said tool member 232, 234 is performed with applied external magnetic fields. Hereby permanent magnets of said sensor means are used for amplification. This is depicted in grader detail with reference to FIG. 3*e*.

According to an embodiment said sensor means comprises capacitor members, such as for example plate capacitors, arranged for capacitive sensing of said waves in said tool member 232, 234. This may be arranged in a suitable way so as to in a corresponding way as inductive members detecting waves of said tool member 232, 234.

The first control unit 200 is arranged to determine efficiency of said drilling process on the basis of detected waves of said tool member. The first control unit 200 is according to an embodiment arranged to control operation of said drilling configuration on the basis of said determined efficiency. Hereby for example feeding pressure of the drilling configuration 299 may be controlled. Hereby for example rotational speed of said drilling steel 234 may be controlled. Hereby for example striking frequency of said drilling machine 230 may be controlled. Also other functions hereby may be controlled, such as for example flushing of said drilling process. According to an embodiment said first control unit 200 is arranged for automatically controlling operation of said drilling configuration on the basis of said determined efficiency. According to another embodiment said control unit 200 is arranged for continuously or intermittently by means of said presentation means 280 present information for an operator of the drilling configuration 299 regarding adaption of operation of said drilling configuration 299 on the basis of said determined efficiency.

Controlling operation of said drilling configuration 299 may involve to minimize the shock wave reflexes from the rock of said tool member. Where minimum energy of reflex waves is presented a maximal of energy is transferred in to the rock. Controlling of operation of said drilling configuration 299 may aim for optimizing towards a certain proportion between tensile waves and pressure waves of said tool member. Further analysis of said detected waves may be used for determining whether any or some of the connections of said drilling steel 234 are loose. Further, detected shock waves of the tool member may be used for determining a prevailing state of a striking arrangement of said drilling machine 230. Further, detected shock waves of the tool member may be used for determining a prevailing state of a damping system of the drilling configuration 299. Hereby a measure of the performance of the damping system may be determined.

Figure 3B:
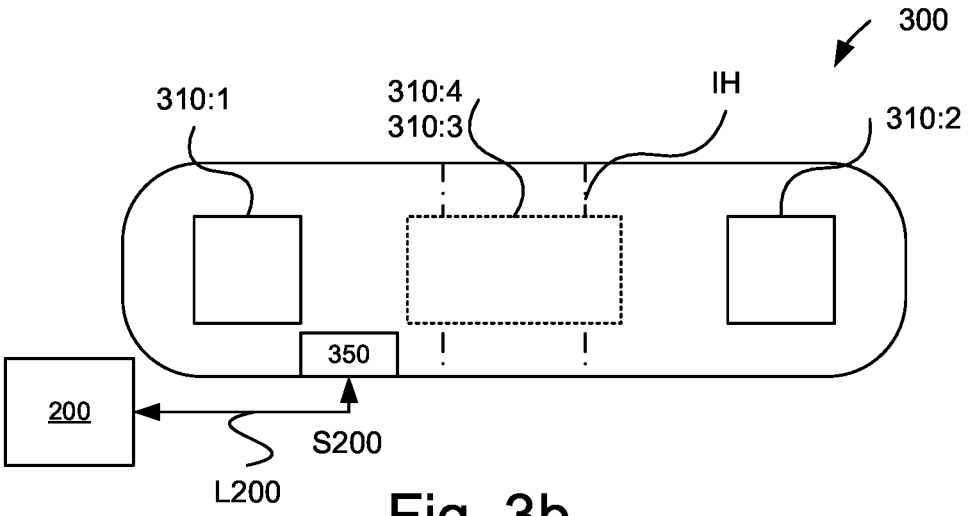
FIG. 3*b* schematically illustrates a detecting unit, according to an embodiment of the invention.

FIG. 3*b* schematically illustrates a cross section view of said detection unit 300, according to an embodiment of the invention. Said detection unit 300 may comprise an outer enclosure consisting of for example plastics or other suitable material. Said detection unit 300 may comprise a suitable shock damping material enclosing the sensor means 310:1, 310:2, 310:3 and 310:4 and the processing unit 350. Said shock damping material may for example comprise a gel that is functioning as electrically and thermally insolating and presents good shock damping properties.

Figure 3C:
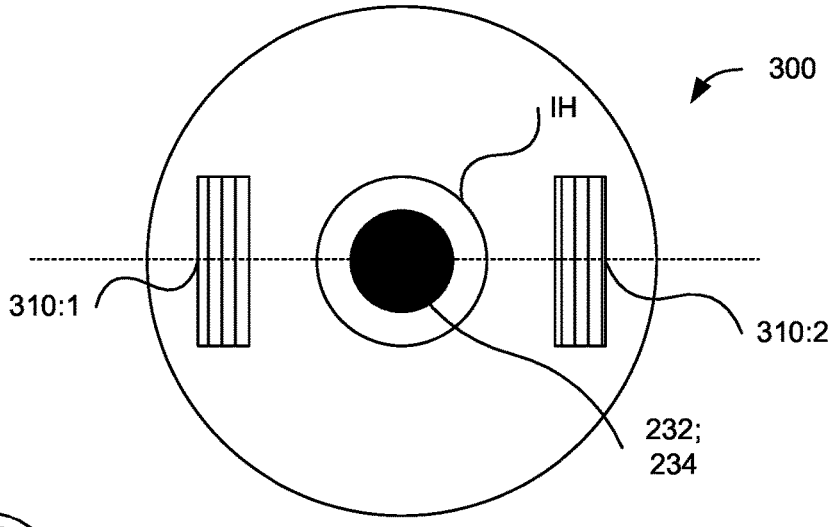
FIG. 3*c* schematically illustrates a detecting unit, according to an embodiment of the invention.

FIG. 3*c* is schematically illustrating a detection unit 300, according to an embodiment of the invention. According to this example said detection unit 300 comprises two sensor means in the form of inductive coil members 310:1 and 310:2. The inductive coil members are positioned diametrically opposite with a respective central axis perpendicular to a longitudinal axis of said tool member 232, 234. The inventive method works well with only two sensor members, but accuracy of the detection of waves of said tool member 232, 234 is increasing with the number of sensor members. It should be noted that it is advantageous to arrange said sensor members pairwise, i.e. multiples of 2, for example 4, 6 or 8 sensor members. The respective pairs may hereby be arranged opposite to each other, which is exemplified with reference to FIG. 3*d*. In FIG. 3*d* four pairs of sensor means are arranged with an internal angle V of 45 degrees. It should be noted that the inventive method is applicable also where an odd number of sensor members are provided, as for such of example three, five or seven sensor members, even though it is computational more complicated to determine efficiency of said drilling process. By processing sensor means pairwise determination of characteristics of said detected waves may be processed with higher accuracy. This because detected amplitudes of waves of two opposite positioned sensor means may be normalized. This is an advantageous way of determining energy content of detective waves.

According to an example embodiment there is provided additional sensors oriented in a symmetrical configuration corresponding to a certain rotation relative an already existing configuration of sensor means for detecting torsion waves in said tool member. These additional sensor means may be substantially identical with existing sensor means 310:1 etc. The additional sensor means may also be arranged pairwise in a corresponding way as the already provided said sensor means. By arranging these additional sensor means (for example inductive coil members) with a different orientation than the existing sensor means torsion waves of the tool member 232, 234 may be detected in an efficient manner. Hereby the additional coil members present not only a central axis which is parallel to a radial direction of said tool member 232, 234. In other words the additional coil members do not present a central axis which is perpendicular to a longitudinal direction of said tool member 232, 234.

FIG. 3*d* schematically illustrates a detection device 300, according to an embodiment of the invention. According to this embodiment four pairs of sensor means are symmetrically arranged on mutually opposite sides of aid tool member 234, 234 adjacent to, on a certain distance from, said tool member 232, 234. Hereby the sensor means 310:1 and 310:2 constitute a first pair. Hereby the sensor means 310:3 and 310:4 constitute a second pair. Hereby the sensor means 310:5 and 310:6 constitute a third pair. Hereby the sensor means 310:7 and 310:8 constitute a fourth pair.

By first determining amplitudes of a wave detected by means of the sensor means in one of said pairs and normalizing these an accurate determining of characteristics of said wave is achieved. Hereby normalized amplitudes are determined for the relevant detected wave, after which adding and mean value determination of all detected amplitudes is performed. This is performed by means of the first control unit 200.

Figure 3E:
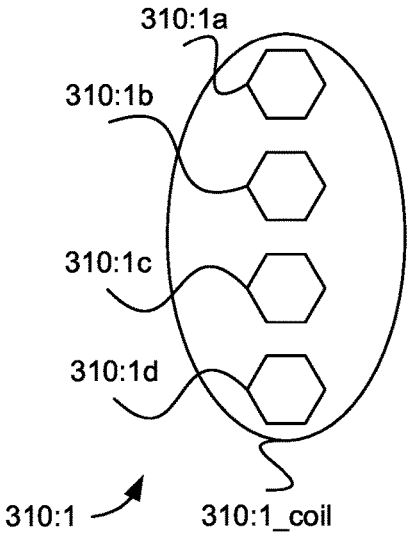
FIG. 3*e* schematically illustrates a sensor means, according to an embodiment of the invention.
Figure 3D:
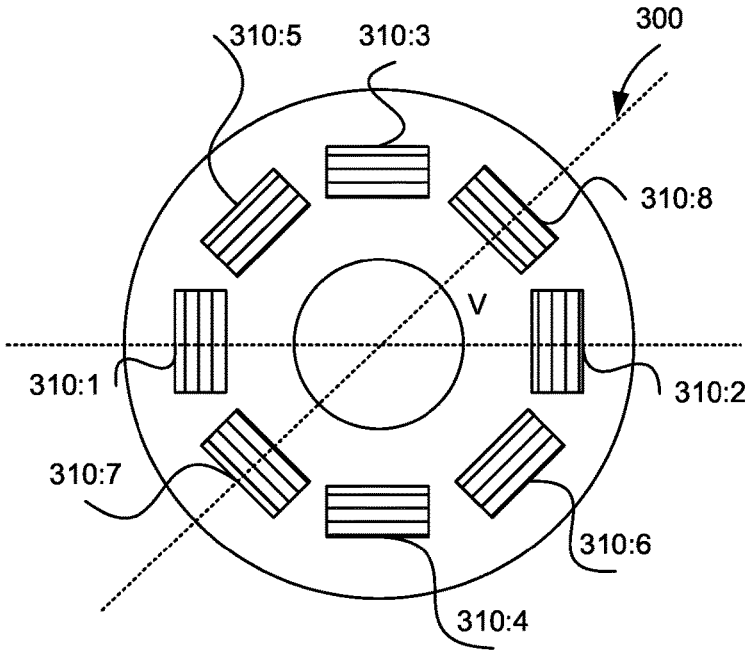
FIG. 3*d* schematically illustrates a detecting unit, according to an embodiment of the invention.

FIG. 3*e* schematically illustrates a coil member 310:1 of said detection unit 300, according to an embodiment of the invention. According to this example said coil member 310:1 comprises four permanent magnets 310:1*a*, 310:1*b*, 310:1*c* and 310:1*d* arranged within the wiring of the coil members for amplifying changes generated by waves of the tool member 232, 234. An arbitrary number of permanent magnets may be arranged at said coil member 310:1. Preferably all coil members of the detection device 300 comprise substantially similar sets of permanent magnets.

According to an example the coil members of the detection device present an elliptical cross section. Said elliptic form is advantageous for more accurate detecting flanks of the waves which are propagating in said tool member. The higher ratio between the axis of the ellipse the more accurate said flaks may be detected. It should be noted that said coil member also may present a circular cross section according to an embodiment of the present invention. According to alternative embodiments the coil members of the detection device 300 may present having other forms than elliptical, for example rectangular.

Figure 4A:
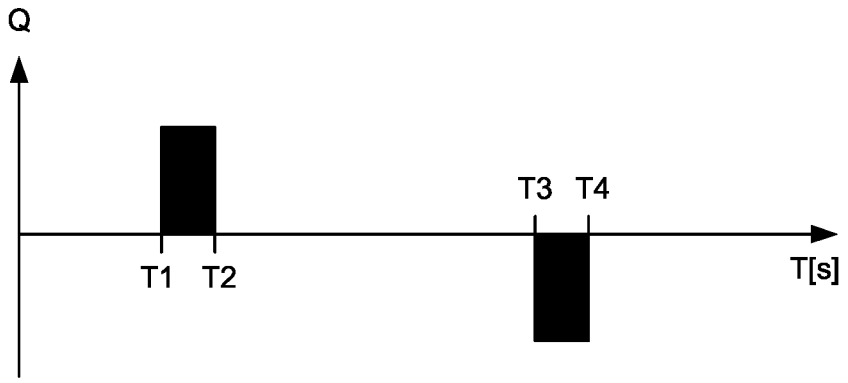
FIG. 4*a* schematically illustrates a diagram of wave propagation in a drilling steel.

FIG. 4*a* schematically illustrates a diagram of wave propagation in said tool member 232, 234. According to this example said cutter is not in contact with the material which should be mined. The tool member hereby presents a free end (cutter). Hereby a quantity Q as function of time T given in seconds is presented. Q is a representation of a quantity which is associated with and proportional to strain in in said tool member 232, 234. Amplitude Q for waves may hereby be measured by means of said detection device. The quantity Q is proportional to amplitude of the waves which are detected. According to this example it is illustrated how a shock wave, generated by a striking arrangement of the drilling machine 230 is detected at a first point of time T1. The duration of the wave is T2-T1. This shock wave is reflected in the cutter of the tool member and a tension wave (propagating in a direction opposite of the corresponding shock wave) appears at a point of time T3 and has a duration T4-T3.

Figure 4B:
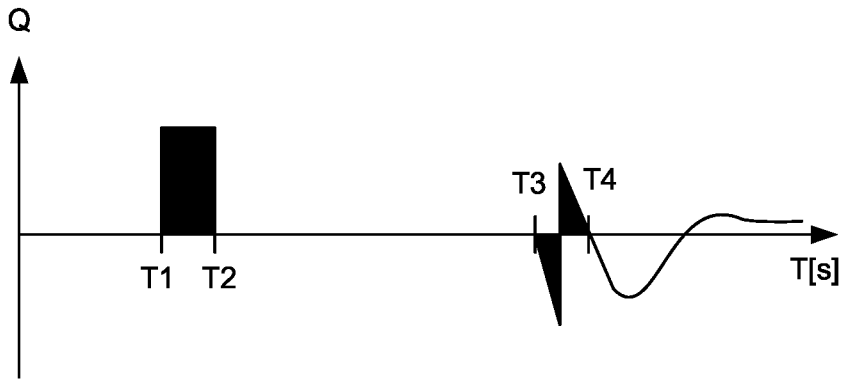
FIG. 4*b* schematically illustrates a diagram of wave propagation in a drilling steel.

FIG. 4*b* schematically illustrates a diagram of wave propagation in said tool member 232, 234 where said cutter 236 is positioned against the material which is to be mined. Said tool member is hereby rotated. In a corresponding way a shock wave is hereby appearing, generated by a striking arrangement of the drilling machine 230, which is detected at a first point of time T1. The duration of the wave is T2-T1. This shock wave is causing breaking of said material and a corresponding tensile wave (propagating in a direction opposite the corresponding shock wave) appears at a point of time T3 and has a duration T4-T3.

By analysing energy content of said shock wave and a corresponding tensile wave it may be determined how effective said drilling process really is. There are different ways of analysing this. According to one example an amplitude of each respective wave may be integrated regarding time T for achieving a respective measure of energy content.

Figure 5A:
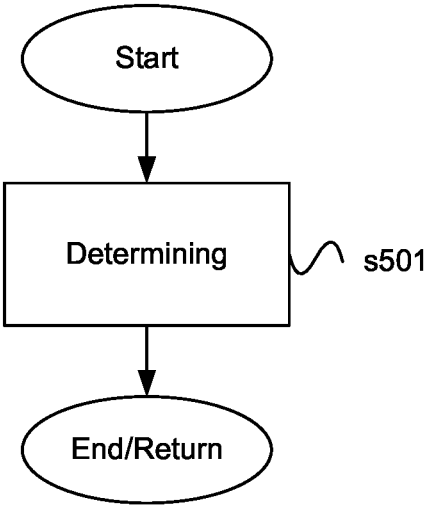
FIG. 5*a* schematically illustrates a flow chart of a method, according to an embodiment of the invention.
Figure 5B:
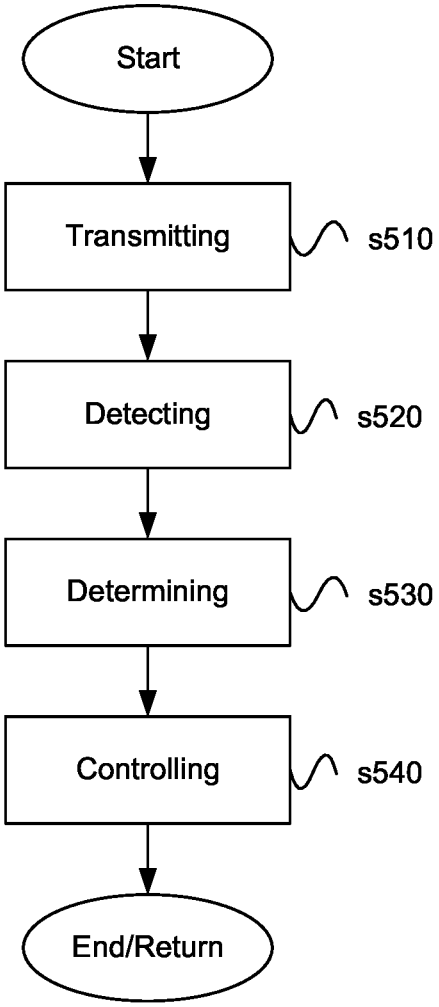
FIG. 5*b* in greater detail schematically illustrates a flow chart of a method, according to an embodiment of the invention.

FIG. 5*a* schematically illustrates a flowchart of a method for determining efficiency of a drilling process, according to an embodiment of the invention. The method comprises a first method step s501. The step s501 comprises the steps of:

- transferring energy via a tool member 232, 234 to the material in which drilling is to be performed by means of a drilling configuration 299;
- detecting waves which are propagating in said tool member 232, 234 of said drilling configuration 299 during drilling as a result of energy provision;
- detecting said waves by means of at least two sensor means 310:1; 310:2 arranged on mutually opposite sides of said tool member 232, 234 adjacent to, on a certain distance from, said tool member 232, 234, which sensor means are based on inductive and/or capacitive detection of said waves in said tool member 232, 234; and
- based on results of said detection, determining said efficiency of said drilling process.

After the step s501 the method is ended/returned.

FIG. 5*a* schematically illustrates a flowchart of a method for determining efficiency of a drilling process, according to an embodiment of the invention.

The method comprises a first method step s510. The step s510 comprises the step of transferring energy via a tool member 232, 234 to the material in which drilling is to be performed by means of a drilling configuration 299. Said energy may be provided by means of strikes of said drilling machine and/or rotational movement of said tool member 232, 234. It should be noted that a feeder pressure is applied to said drilling configuration 299. After the step s510 a subsequent step s520 is performed.

The step s520 comprises the step of detecting waves which are propagating in said tool member 232, 234 of said drilling configuration 299 during drilling as a result of energy provision. These waves may be pressure waves and corresponding by the rock reflected waves. These waves may comprise torsion waves. Detection of these waves is performed by means of the inventive detection device 300. Said waves may be detected by at least two sensor means 310:1, 310:2 arranged at mutually opposite sides of said tool member 232, 234 adjacent to, on a certain distance from, said tool member (232, 234), which sensor means 310:1; 310:2 are based on inductive and/or capacitive detection of said waves in said tool member 232, 234.

After the step s520 a subsequent step s530 is performed.

The step s530 comprises the step of, based on results of said detection, determining said efficiency of said drilling process. This may be performed in various ways. According to one embodiment said efficiency of the drilling process is determined on the basis of comparisons between original pressure waves and reflecting tension waves in said tool member 232, 234. Hereby a difference regarding energy content between the waves may be determined. Which difference is indicating efficiency of the drilling process. According to another embodiment said efficiency of said drilling process may be determined on the basis of characteristics of a few reoccurring tension waves in said tool member. This is applicable when no strikes are provided by the drilling configuration 299.

In a case where said waves are detected by means of four sensor means 310:1; 310:2; 310:3; 310:4 symmetrically arranged on mutually opposite sides of said tool member 232, 234 results from said sensor means 310:1; 310:2; 310:3; 310:4 may be processed pairwise as basis for said determination.

After the step s530 a subsequent step s540 is performed.

The step s540 comprises the step of continuously controlling said drilling process based on such determined efficiency for an efficiency optimization. This can according to one embodiment be performed automatically by means of said first control unit 200. According to one embodiment an operator of the drilling configuration 299 can control said drilling process on basis of instructions presented by means of said presentation means 280. After the step s540 the method is ended/returned.

Figure 6:
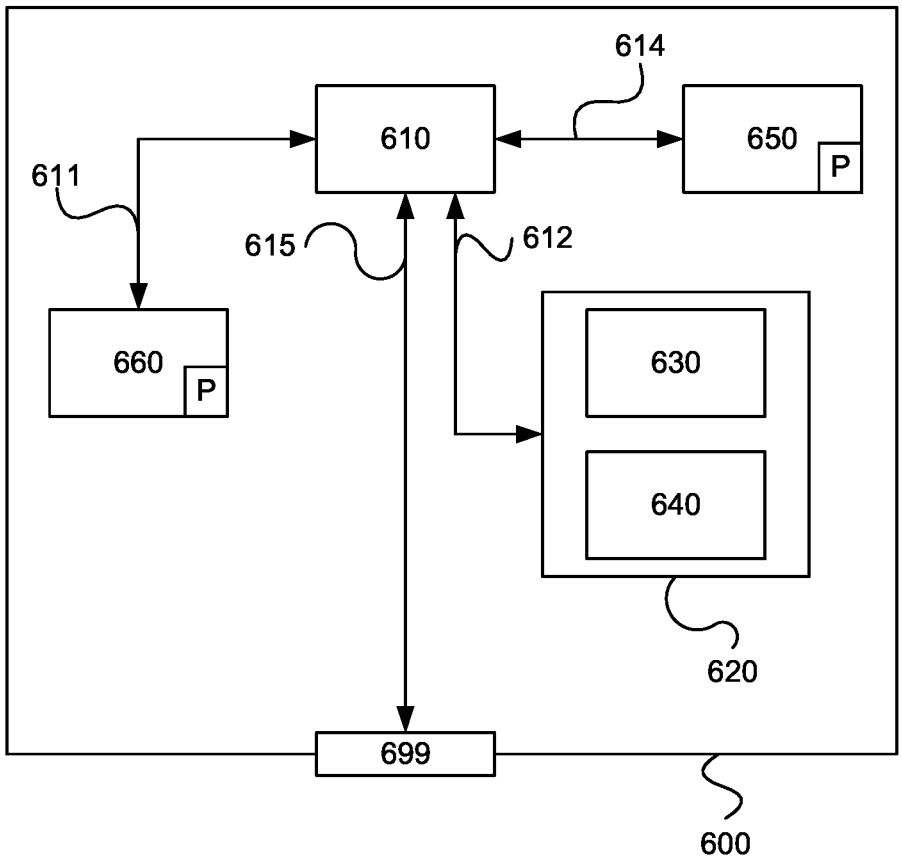
FIG. 6 schematically illustrates a computer, according to an embodiment of the invention.

With reference to FIG. 6 there is illustrated a diagram of one version of a device 600. The control units 200 and 210 described with reference to FIG. 2 may in one version comprise the device 600. The device 600 comprises a non-volatile memory 620, a data processing unit 610 and a read/write memory 650. The non-volatile memory 620 has a first memory element 630 in which a computer program, e.g. an operating system, is stored for controlling the function of the device 600. The device 600 further comprises a bus controller, a serial communication port, I/O means, an A/D converter, a time and date input and transfer unit, an event counter and an interruption controller (not depicted). The non-volatile memory 620 has also a second memory element 640.

There is provided a computer program P comprising routines for determining efficiency of a drilling process where energy is transferred via a tool member 232, 234 to the material in which drilling is to be performed by means of a drilling configuration 299.

The computer program P may comprise routines for detecting waves which are propagating in said tool member 232, 234 of said drilling configuration 299 during drilling as a result of energy provision.

The computer program P may comprise routines for detecting said waves by means of at least two sensor means 310:1; 310:2 arranged on mutually opposite sides of said tool member 232, 234 adjacent to, on a certain distance from, said tool member 232, 234, which sensor means 310:1; 310:2 are based on inductive and/or capacitive detection of said waves in said tool member 232, 234.

The computer program P may comprise routines for, based on results of said detection, determining said efficiency of said drilling process.

The computer program P may comprise routines for detecting said waves by means of four sensor means 310:1; 310:2, 310:3; 310:4 symmetrically arranged at mutually opposite sides of said tool member 232, 234 adjacent to, on a certain distance from, said tool member 232, 234.

The computer program P may comprise routines for processing results from said sensor means 310:1; 310:2, 310:3; 310:4 pairwise (310:1, 310:2; 310:3, 310:4) as basis for said determination.

The computer program P may comprise routines for detecting said waves wherein said sensor are positioned at a preferred position along said tool member 232, 234 where lateral movements of said tool member 232, 234 are relatively small.

The computer program P may comprise routines for controlling operation of said tool member 232, 234 whereby said energy is provided by means of strikes and/or rotation.

The computer program P may comprise routines for inductively detecting said waves by means of oppositely arranged coil members 310:1, 310:2 comprising at least one permanent magnet 310:1*a* as coil core.

The computer program P may comprise routines for determining said efficiency of said drilling process on the basis of comparisons between original pressure waves and reflecting tensile waves in said tool member 232, 234.

The computer program P may comprise routines for determining said efficiency of said drilling process on the basis of characteristics of a few reoccurring tensile waves in said tool member 232, 234.

The computer program P may comprise routines for detecting waves in said tool member 232, 234 by means of additional sensor means oriented in a symmetrical configuration corresponding to a certain rotation relatively an already provided configuration of sensor means for detection of torsion waves in said tool member 232, 234.

The computer program P may comprise routines for continuously controlling said drilling process based on such determined efficiency for an efficiency optimization.

The program P may be stored in an executable form or in compressed form in a memory 660 and/or in a read/write memory 650.

Where it is stated that the data processing unit 610 performs a certain function, it means that it conducts a certain part of the program which is stored in the memory 660 or a certain part of the program which is stored in the read/write memory 650.

The data processing device 610 can communicate with a data port 699 via a data bus 615. The non-volatile memory 620 is intended for communication with the data processing unit 610 via a data bus 612. The separate memory 660 is intended to communicate with the data processing unit 610 via a data bus 611. The read/write memory 650 is arranged to communicate with the data processing unit 610 via a data bus 614. The links L200, L210 and L280, for example, may be connected to the data port 699 (see FIG. 2). When data are received on the data port 699, they are stored temporarily in the second memory element 640. When input data received have been temporarily stored, the data processing unit 610 will be prepared to conduct code execution as described above. According to one embodiment the signals received on the data port 699 comprises information about energy content of pressure waves and tensile waves in said tool member. According to one embodiment the signals received on the data port 699 comprises information about torsion waves in said tool member. The signals received on the data port 699 may be used by the device 600 for determining said efficiency of said drilling process.

Parts of the methods herein described may be conducted by the device 600 by means of the data processing unit 610 which runs the program stored in the memory 660 or the read/write memory 650. When the device 600 runs the program, method steps described herein are executed.

The foregoing description of the preferred embodiments of the present invention is provided for illustrative and descriptive purposes. It is not intended to be exhaustive, nor to limit the invention to the variants described. Many modifications and variations will obviously suggest themselves to one skilled in the art. The embodiments have been chosen and described in order to best explain the principles of the invention and their practical applications and thereby make it possible for one skilled in the art to understand the invention for different embodiments and with the various modifications appropriate to the intended use.

The invention claimed is:

1. A method for determining excavating efficiency of a drilling process, comprising the steps of:

transferring energy, via a tool member, to a material in which drilling is to be performed by means of a drilling configuration;

detecting waves, which are propagating in said tool member of said drilling configuration during drilling, via a detection unit arranged about the tool member, wherein detecting waves comprises detecting original shock waves generated by the drilling configuration and corresponding reflected tensile waves propagating in a direction opposite the original shock waves;

wherein detecting said waves comprises inductive and/or capacitive detection performed by at least two pairs of sensors symmetrically arranged in the detection unit, wherein each pair of sensors comprises two coil members arranged on mutually opposite sides of said tool member, adjacent to, and at a distance from, said tool member, wherein the coil members are arranged in a substantially elliptical configuration having the shortest ellipse axis parallel with a longitudinal direction of said tool member, and wherein detecting the waves comprises pairwise processing of said detection from each pair of sensors of the at least two pairs of sensors; and determining said excavating efficiency of said drilling process based on comparisons between the detected original shock waves and the corresponding reflected tensile waves in said tool member, whereby a difference regarding energy content between the waves is determined, the difference indicates said excavating efficiency of said drilling process.

2. The method according to claim 1, comprising the step of:

transferring said energy by means of strikes and/or rotation.

3. The method according to claim 1, comprising the step of:

continuously controlling said drilling process based on such determined excavating efficiency for an efficiency optimization.

4. A system for determining excavating efficiency of a drilling process, comprising:

a drilling configuration for transferring energy via a tool member to a material in which drilling is to be performed;

a detection unit arranged about the tool member of the drilling configuration, wherein the detection unit comprises at least two pairs of sensors configured for detecting one or more original shock waves generated by the drilling configuration and corresponding reflected tensile waves propagating in a direction opposite the original shock waves through inductive and/or capacitive detection, and wherein the at least two pairs of sensors are symmetrically arranged in the detection unit, wherein each pair of sensors comprises two coil members arranged on mutually opposite sides of said tool member, adjacent to, and at a distance from said tool member, wherein the coil members are arranged in a substantially elliptical configuration having the shortest ellipse axis parallel with a longitudinal direction of said tool member; and at least one control unit configured to receive the inductive and/or capacitive detection results from the at least two pairs of sensors, and to perform pairwise processing of the detection results for each pair of sensors of the at least two pairs of sensors, wherein the at least one control unit is further configured for determining said excavating efficiency of said drilling process based on comparisons between the detected original shock waves and the corresponding reflected tensile waves in said tool member, whereby a difference regarding energy content between the waves is determined, the difference indicates said excavating efficiency of said drilling process.

5. The system according to claim 4, wherein the drilling configuration is configured for providing said energy by means of strikes and/or rotation.

6. The system according to claim 4, wherein each pair of sensors comprise:

oppositely arranged coil members, each coil member comprising at least one permanent magnet as a coil core for inductively detecting said waves.

7. The system according to claim 4, wherein the at least one control unit is configured for continuously controlling said drilling process based on such determined excavating efficiency for an efficiency optimization.

8. A drilling rig comprising a system according to claim 4.

9. A computer program product comprising a computer-readable medium, and instructions stored on the computer-readable medium loadable into an electronic control unit or a computer connected to the electronic control unit and configured to cause execution of the method steps according to claim 1, when said instructions are ran on the electronic control unit or the computer connected to the electronic control unit.

* * * * *